US011205401B1

(12) United States Patent
Jeng et al.

(10) Patent No.: US 11,205,401 B1
(45) Date of Patent: Dec. 21, 2021

(54) HDMI DEVICE AND POWER-SAVING METHOD FOR IMMEDIATELY SWITCHING HDMI PORTS

(71) Applicant: MEDIATEK INC., Hsinchu (TW)

(72) Inventors: You-Tsai Jeng, Hsinchu (TW); Kai-Wen Cheng, Hsinchu (TW); Chin-Lung Lin, Hsinchu (TW); Yi-Cheng Chen, Hsinchu (TW); Te-Chuan Wang, Hsinchu (TW); Chi-Chih Chen, Hsinchu (TW); Szu-Hsiang Lai, Hsinchu (TW); Tai-Lai Tung, Hsinchu (TW); Keng-Lon Lei, Hsinchu (TW)

(73) Assignee: MEDIATEK INC., Hsinchu (TW)

( * ) Notice: Subject to any disclaimer, the term of this patent is extended or adjusted under 35 U.S.C. 154(b) by 0 days.

(21) Appl. No.: 17/242,409

(22) Filed: Apr. 28, 2021

(51) Int. Cl.
*G09G 5/12* (2006.01)

(52) U.S. Cl.
CPC ..... *G09G 5/12* (2013.01); *G09G 2330/023* (2013.01); *G09G 2330/027* (2013.01)

(58) Field of Classification Search
CPC .... G09G 5/12; G09G 2330/023; G09G 5/006; G09G 2370/12; G09G 2330/027; G09G 2370/22
See application file for complete search history.

(56) References Cited

U.S. PATENT DOCUMENTS

2011/0022739 A1* 1/2011 Guillerm ..... H04N 5/775 710/18
2013/0054842 A1* 2/2013 Overby ..... G09G 5/008 710/5
2015/0042887 A1* 2/2015 Schanin ..... H04N 21/43635 348/706
2016/0156843 A1* 6/2016 Aokage ..... H04N 5/23235 348/222.1

* cited by examiner

*Primary Examiner* — Abbas I Abdulselam
(74) *Attorney, Agent, or Firm* — McClure, Qualey & Rodack, LLP

(57) ABSTRACT

A power-saving method for switching High Definition Multimedia Interface (HDMI) ports on a sink device is provided. The sink device has a first HDMI port initially being enabled for displaying and a second HDMI port being disabled for displaying. The power-saving method includes the steps of using the reference signals to locate the VSYNC active edge in each frame generated by a source device connected to the second HDMI port; turning on the power to the second HDMI port during a power-on region corresponding to the VSYNC active edge in each frame and turning off power otherwise; obtaining information related to a high bandwidth digital content protection (HDCP) in the power-on region; and displaying video data from the source device based on the HDCP information when enabling the second HDMI port connected to the source device.

14 Claims, 4 Drawing Sheets

HDMI DEVICE AND POWER-SAVING METHOD FOR IMMEDIATELY SWITCHING HDMI PORTS

BACKGROUND OF THE INVENTION

Field of the Invention

The invention generally relates to an audio and video transmitting technology, and more particularly, to power saving aspects of the High-Definition Multimedia Interface (HDMI) technology.

Description of the Related Art

High-Definition Multimedia Interface (HDMI) is a licensable audio/video connector interface for transmitting uncompressed or compressed, encrypted digital streams. Video and Audio data provided by various DRM-enforcing digital audio/video source devices, such as a set-top box, a HD DVD Disc player, a Blu-ray Disc player, a Personal Computer, a video game console or an AV receiver, can be transmitted to compatible HDMI sink devices such as a digital television (DTV) via the HDMI digital interface. The HDMI standard is initially introduced in 2006 on consumer HDTV camcorders and high-end digital still cameras, representing the DRM (Digital rights management) alternative to consumer analog standards such as RF (coaxial cable), composite video, S-Video, SCART, component video and VGA, and digital standards such as DVI (DVI-D and DVI-I).

HDCP (High-bandwidth Digital Content Protection) is a standard for protecting digital content over certain interfaces; between, for example, a set-top box (STB) transmitting audio and video over HDMI interface and a television receiving HDMI. Protection is accomplished by encrypting the data before it leaves the transmitter. A legitimate receiver then decrypts the data.

In the current HDMI technology, the fast switch function between HDMI ports is required in the HDMI market. However, when the user switches one HDMI port to another HDMI port, because of the HDPC encryption, the sink device and the source are required to perform some synchronization operations first. Therefore, when the user switches one HDMI port to another HDMI port, the user may wait a period of time to see the video displayed in the electronic device corresponding to another HDMI port. Furthermore, although all HDMI ports turned on can synchronize all the HDMI lanes signals in advance to reduce the waiting time, large power consumption will be an issue.

BRIEF SUMMARY OF THE INVENTION

A power-saving method for immediately switching High Definition Multimedia Interface (HDMI) ports and an HDMI device are provided to overcome the problems mentioned above.

An embodiment of the invention provides a power-saving method for switching HDMI ports on a sink device, wherein the sink device has a first HDMI port initially being enabled for displaying and a second HDMI port being disabled for displaying. The power-saving method includes the steps of using the reference signals to locate the VSYNC active edge in each frame generated by a source device connected to the second HDMI port; turning on the power to the second HDMI port during a power-on region corresponding to the VSYNC active edge in each frame and turning off the power otherwise; obtaining information related to a high bandwidth digital content protection (HDCP) in the power-on region; and displaying video data from the source device based on the HDCP information when enabling the second HDMI port connected to the source device.

In some embodiments of the invention, the reference signals comprise at least two of a horizontal data enable signal, a vertical data enable signal, and a timing of pixel location.

In some embodiments of the invention, the VSYNC active edge is located by detecting edges of the reference signals.

In some embodiments of the invention, the power-saving method further comprises the step of detecting whether the edges of the reference signals changing from a first value to a second value.

The power-saving method further comprises the step of synchronizing a first clock of the source device with a second clock of the sink device before the VSYNC signal is located by the reference signals. In addition, the power-saving method further comprises the step of obtaining the HDCP information in the power-on region after the VSYNC signal is located.

In some embodiments of the invention, the HDCP information comprises AVMUTE control information and HDCP control information.

An embodiment of the invention provides a High Definition Multimedia Interface (HDMI) device. The HDMI device comprises an HDMI interface, a controller and a display device. The HDMI interface comprises a plurality of HDMI ports, wherein the plurality of HDMI ports comprise at least a first HDMI port initially being enabled for displaying and a second HDMI port being disabled for displaying. The controller is coupled to the HDMI interface and the display device. The controller uses references signals to locate a VSYNC active edge in each frame generated by a source device connected to the second HDMI port, turns on power to the second HDMI port during a power-on region corresponding to the VSYNC active edge in each frame and turns off the power otherwise, and obtains information related to a high bandwidth digital content protection (HDCP) from the power-on region. Furthermore, the display device displays video data from the source device based on the HDCP information when enabling the second HDMI port connected to the source device.

Other aspects and features of the invention will become apparent to those with ordinary skill in the art upon review of the following descriptions of specific embodiments of HDMI device and power-saving method for immediately switching HDMI ports.

BRIEF DESCRIPTION OF THE DRAWINGS

The invention will become more fully understood by referring to the following detailed description with reference to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
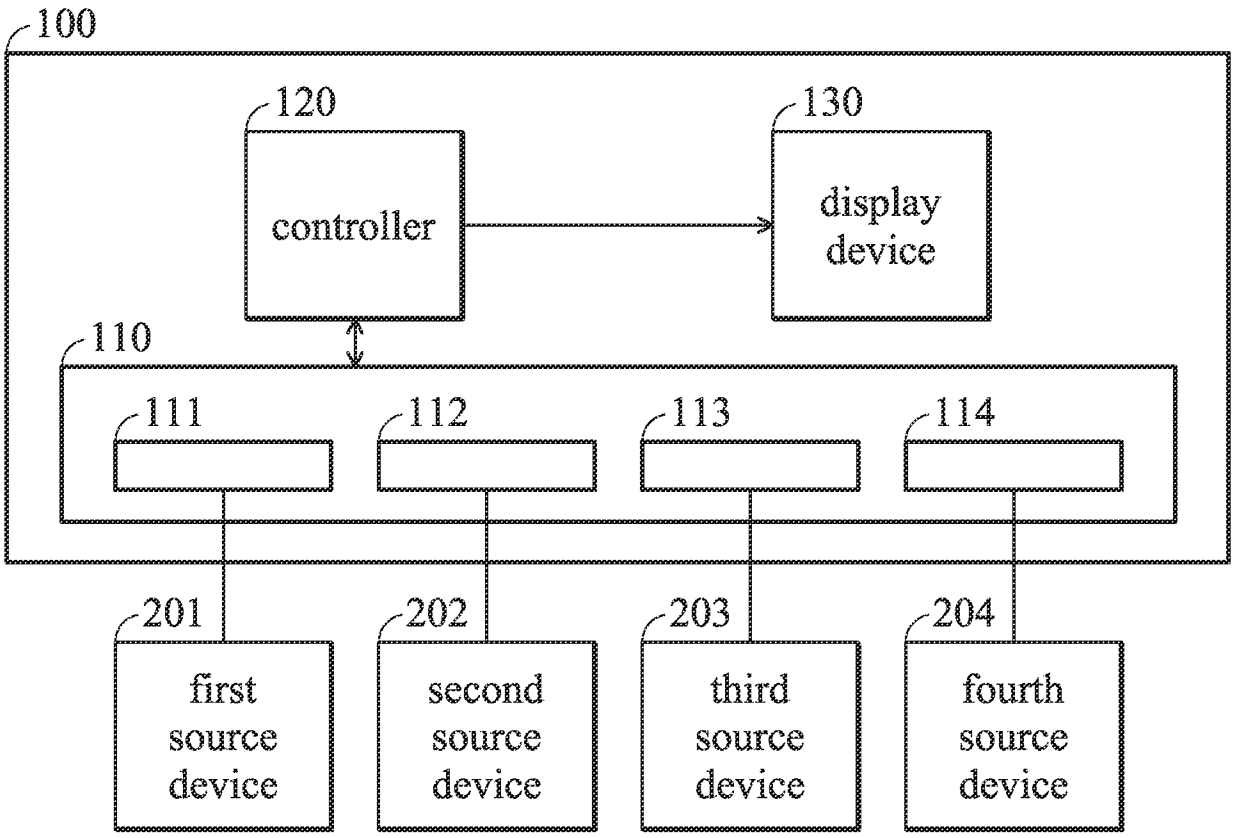
FIG. 1 is a High Definition Multimedia Interface (HDMI) device 100 according to an embodiment of the invention.

FIG. 1 is a High Definition Multimedia Interface (HDMI) device 100 according to an embodiment of the invention. In the embodiments of the invention, the HDMI device 100 can be regarded as a sink device which can support the high bandwidth digital content protection (HDCP) technology, e.g. a television, a repeater or a displaying device, but the invention should not limited thereto.

As shown in FIG. 1, the HDMI device 100 may comprise an HDMI interface 110, a controller 120 and a display device 130. The HDMI interface 110 may comprise a plurality of HDMI ports (e.g. a first HDMI port 111, a second HDMI port 112, a third HDMI port 113 and a fourth HDMI port 114, but the invention should not be limited thereto). The first HDMI port 111, second HDMI port 112, third HDMI port 113 and fourth HDMI port 114 may be respectively connected to the first source device 201, the second source device 202, the third source device 203 and the fourth source device 204 through a respective HDMI connector.

The first source device 201, second source device 202, third source device 203 and fourth source device 204 may comprise DVD player, HD DVD Player, Set Top Box, Game Console, and Blue-Ray Player, but the invention should not be limited thereto.

It should be noted that, in order to clarify the concept of the invention, FIG. 1 is a simplified block diagram in which only the elements relevant to the invention are shown. However, the invention should not be limited to what is shown in FIG. 1.

It is assumed that the user switches to the first HDMI port 111 (i.e. enable the first HDMI port) to watch the video data from the first source device 201. In an embodiment of the invention, for each unused (or disabled) HDMI port (e.g. the second HDMI port 112, third HDMI port 113 and fourth HDMI port 114) connected to a respective source device (e.g. the second source device 202, third source device 203 and fourth source device 204) which is playing a video data, the controller 120 may use at least two reference signals, e.g. a first signal H_de and a second signal V_de, to find or locate a VSYNC active edge in each frame of the video data from the source device. In the embodiments of the invention, the first signal H_de corresponds to the horizontal direction of the frame and the second signal V_de corresponds to the vertical direction of the frame. In an embodiment of the invention, the reference signals may further comprise a timing of pixel location.

In the embodiments of the invention, the controller 120 may scan the pixels in each frame to set the edges of first signal H_de and the second signal V_de. For a pixel of one frame, when there is a pixel in the video-active region (i.e. a region that comprises video data) in the horizontal direction of the frame, the controller 120 may set the edge of the first signal H_de to a first value (e.g. 1); and when the pixel is in the video-active region in the vertical direction of the frame, the controller 120 may set the edge of the second signal V_de to the first value (e.g. 1). In additional, when the pixel is not in the video-active region in the horizontal direction of the frame, the controller 120 may set the edge of the first signal H_de to a second value (e.g. 0); and when the pixel is not in the video-active region in the vertical direction of the frame, the controller 120 may set the edge of the second signal V_de to the second value (e.g. 0).

In the embodiments of the invention, when the controller 120 detects that the edges of the first signal H_de and the second signal V_de are both changed to the second value (e.g. (0, 0)) in the frame, the controller 120 may estimate the location of the VSYNC active edge in the region corresponding to (0, 0). Because in the HDMI and CTA-861 specification, the location of the VSYNC active edge is defined, the controller 120 is able to estimate the location of the VSYNC active edge in the region corresponding to (0, 0). The region corresponding to (0, 0) is regarded as a power-on region in the invention.

Figure 2:
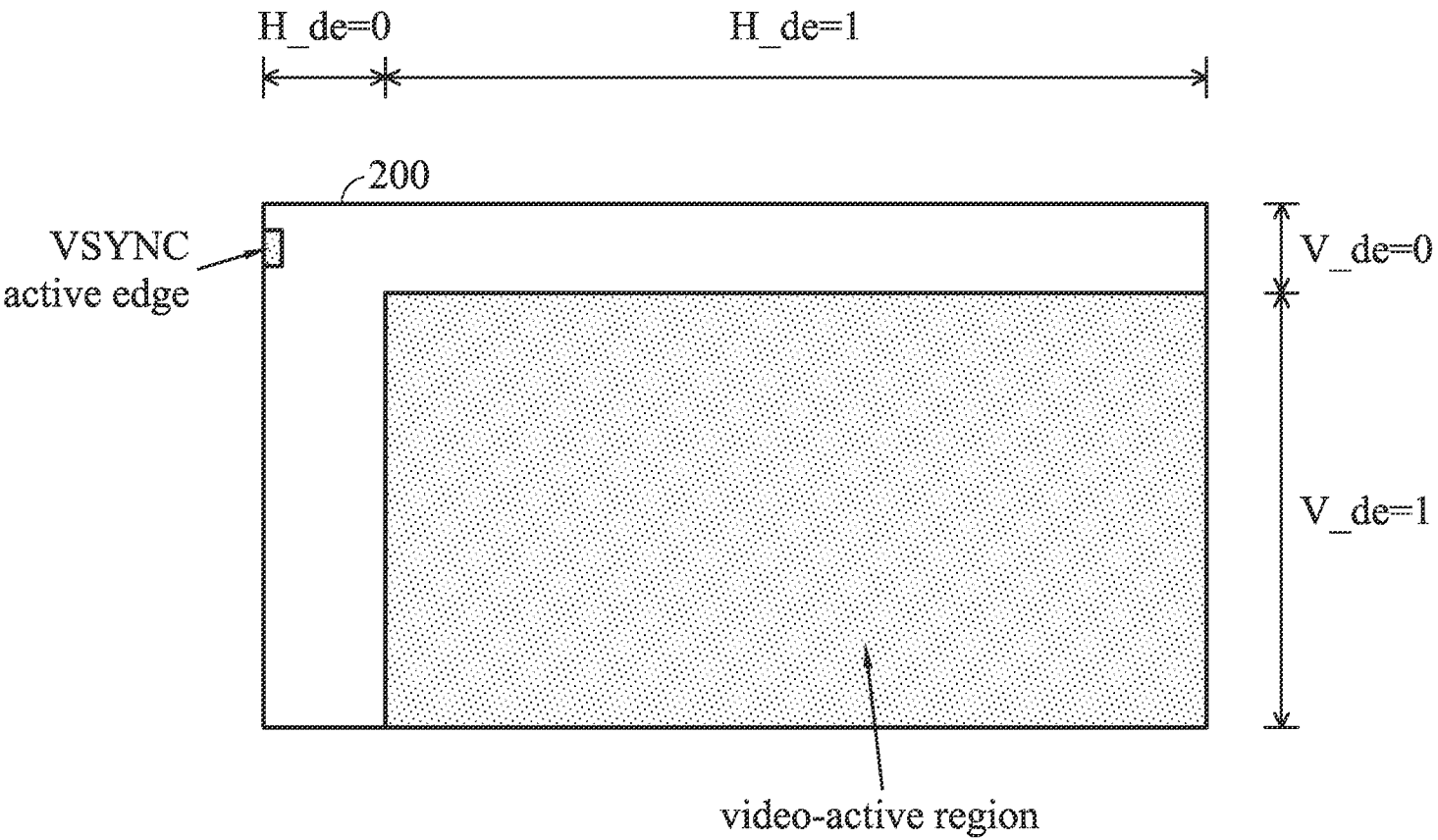
FIG. 2 is a schematic diagram of the VSYNC active edge and the video-active region in a frame according to an embodiment of the invention.

FIG. 2 is a schematic diagram of the VSYNC active edge and the video-active region in a frame according to an embodiment of the invention. As shown in FIG. 2, when the controller 120 detects that the edges of the first signal H_de and the second signal V_de are both the first value (e.g. (1, 1)) in the frame 200, the controller 120 may determine that the pixel is in the video-active region. In addition, when the controller 120 detects that the edges of the first signal H_de and the second signal V_de are both the second value (e.g. (0, 0)) in the frame 200, the controller 120 may estimate the location of the VSYNC active edge in the region corresponding to (0, 0).

After the controller 120 has determined the location of the VSYNC active edge in the frame, the controller 120 may turn on the power to the unused (or disabled) HDMI port during a power-on region corresponding to the VSYNC active edge in the frame. That is to say, except for the power-on region corresponding to the VSYNC active edge, the other regions in the frame are powered off to save power.

Specifically, in the embodiments of the invention, the region corresponding to the VSYNC active edge may comprise two data lines. The first data line L1 is before the VSYNC active edge and the second data line L2 is after the VSYNC active edge. Power to first data line L1 is turned on first by the controller 120 to synchronize the clocks in the HDMI device and the source device connected to the unused HDMI port. Then, power to the second data line L2 is turned on by the controller 120 to obtain the HDCP relative information.

Figure 3:
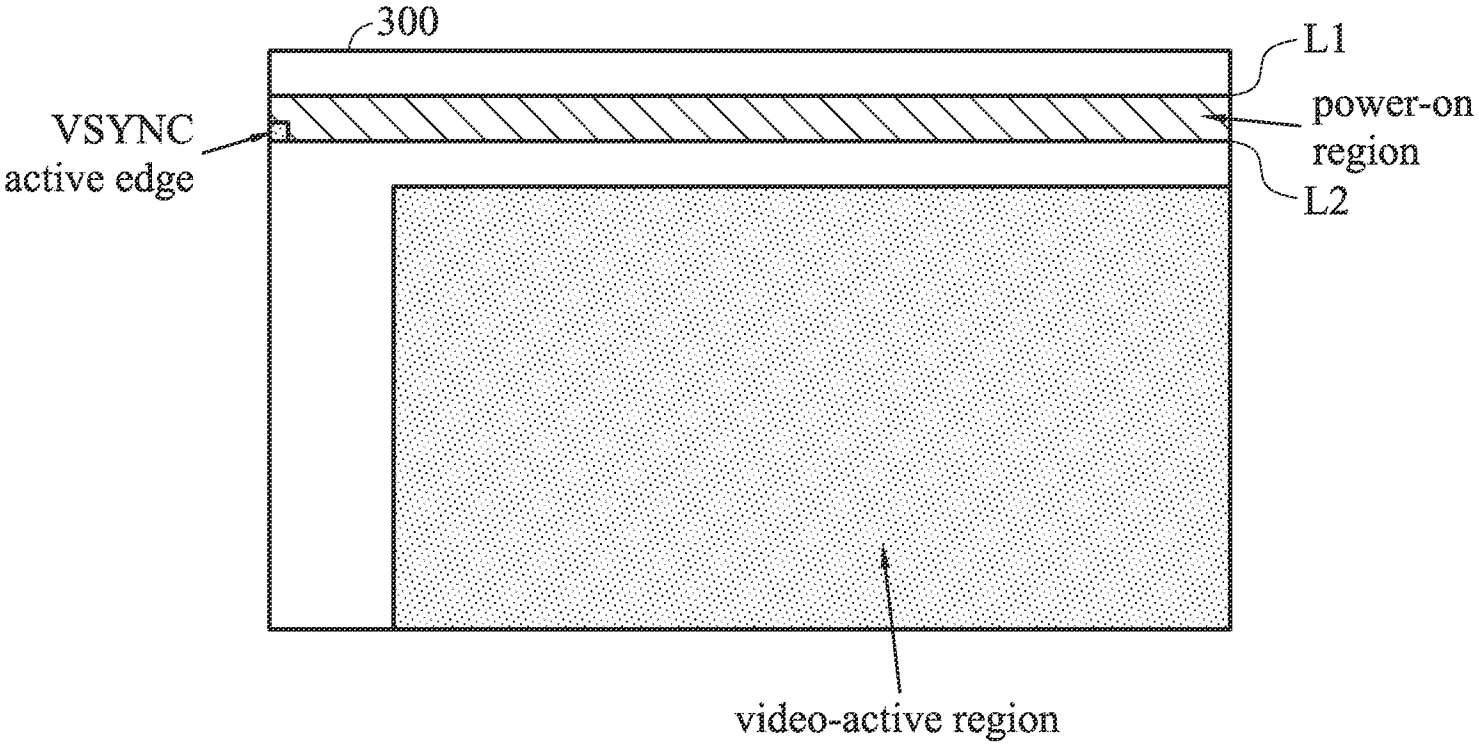
FIG. 3 is a schematic diagram of the power-on region corresponding to the VSYNC active edge in a frame according to an embodiment of the invention.

FIG. 3 is a schematic diagram of the power-on region corresponding to the VSYNC active edge in a frame according to an embodiment of the invention. As shown in FIG. 3, the region between the first line L1 and the second line 2 is the power-on region corresponding to the VSYNC active edge in the frame 300. In FIG. 3, the power is turned on only in the power-on region corresponding to the VSYNC active edge. That is to say, except for the power-on region corresponding to the VSYNC active edge, the other regions in the frame 300 are powered off to save power.

In the embodiments of the invention, the HDCP relative information may comprise the AVMUTE control information and the HDCP control information.

In the HDMI standard, the AVMUTE control information is transmitted between the VSYNC active edge and the 384 pixels following this edge. In addition, in the HDCP standard, the HDCP control information is transmitted between the 512~528 pixel clocks (or TMDS clock) following the VSYNC active edge.

According to the AVMUTE control information, the controller 120 can know which frame is muted and in which frame the HDPC cipher cannot be performed (i.e. the input frame counter (inputCtr) of the HDPC cipher will not be increased by 1 in the muted frame).

Furthermore, according to the HDCP control information, the controller 120 can know the information of the control signals in the lane 1 and lane 2 of the HDMI transmission. According to the information of the control signals in the lane 1 and lane 2, the controller 120 can know which frame is encrypted through the HDPC cipher and which frame is not encrypted through the HDPC cipher.

Therefore, according to the AVMUTE control information and the HDCP control information, the controller 120 can know the current frame counter value of the input frame counter (inputCtr) of the HDPC cipher.

When the user switches from one HDMI port to another HDMI port which is unused originally, the display device 130 can immediately displays the video data from the source device connected to the HDMI port according to the known HDCP relative information. For example, when the switch from the first HDMI port 111 to the second HDMI port 112 which is unused originally, the display device 130 can immediately displays the video data from the second source device 202 connected to the second HDMI port 112 according to the known HDCP relative information.

In addition, as discussion above, the controller 120 may also use the first signal H_de and the second signal V_de to find or detect a VSYNC active edge in each frame of the video data from the source device 201 which is connected to the unused first HDMI port 111.

Figure 4:
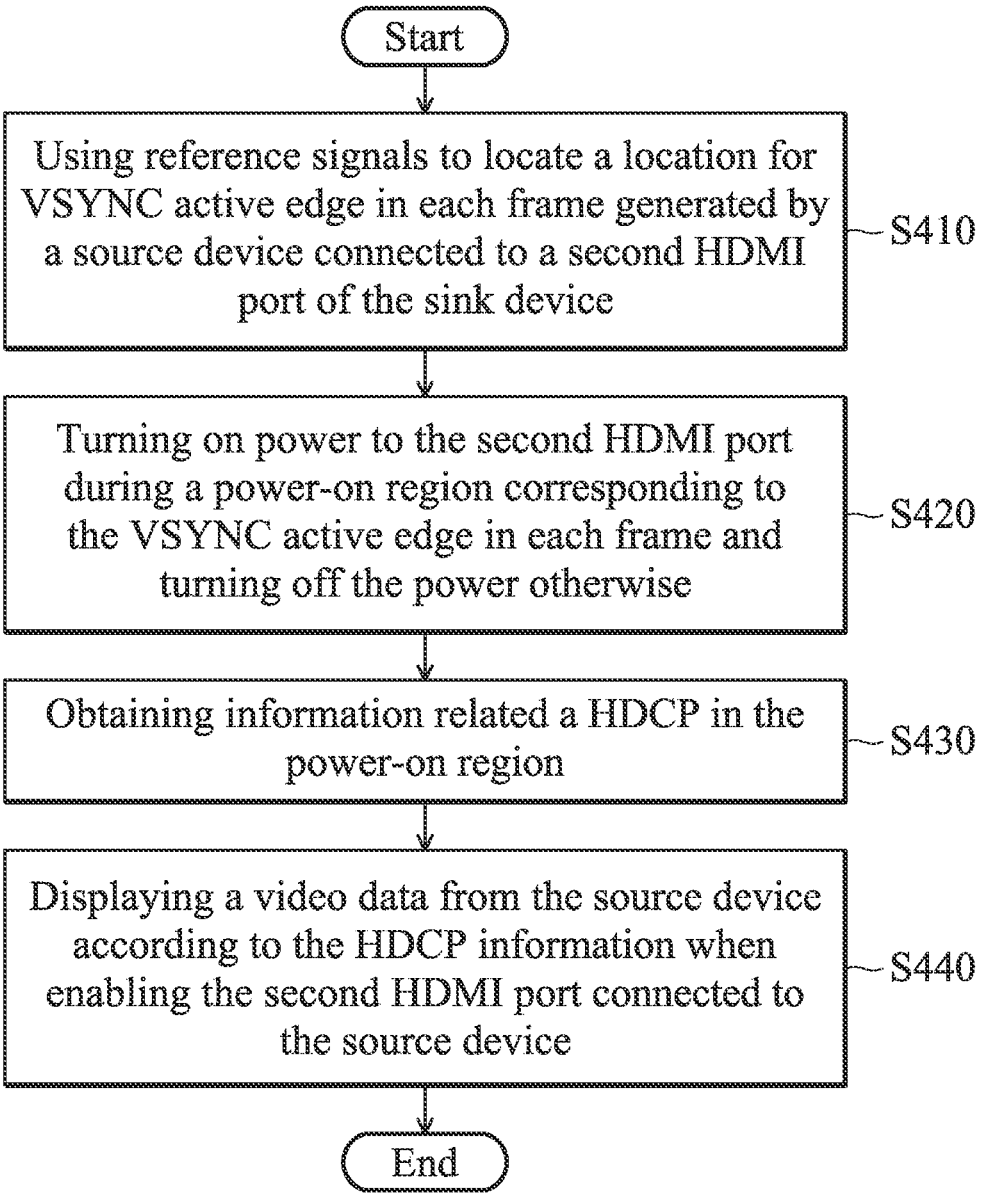
FIG. 4 is a flow chart 400 illustrating a power-saving method for switching HDMI ports according to an embodiment of the invention.

FIG. 4 is a flow chart 400 illustrating a power-saving method for switching HDMI ports according to an embodiment of the invention. The power-saving method for switching HDMI ports can be applied to a sink device (e.g. the HDMI device 100), wherein the sink device having a first HDMI port initially being enabled for displaying and a second HDMI port being disabled for displaying. As shown in FIG. 4, in step 410, the sink device uses the references signals to locate the VSYNC active edge in each frame generated by a source device connected to the second HDMI port of the sink device.

In step S420, the sink device turns on the power to the second HDMI port during a power-on region corresponding to the VSYNC active edge in each frame and turns off power otherwise.

In step S430, the sink device obtains the information related to a high bandwidth digital content protection (HDCP) in the power-on region.

In step S440, the sink device displays a video from the source device based on the HDCP information when enabling the second HDMI port corresponding to the source device.

In the embodiments of the invention, in the power-saving method, the reference signals comprise at least two of a horizontal data enable signal, a vertical data enable signal, and a timing of pixel location.

In the embodiments of the invention, in the power-saving method, the VSYNC active edge is located by detecting edges of the reference signals.

In the embodiments of the invention, in the power-saving method, when detecting edges of the reference signals, the sink device detects whether the edges of the reference signals changing from a first value to a second value.

In the embodiments of the invention, in the power-saving method, the sink device further synchronizes a first clock of the source device with a second clock of the sink device before the VSYNC signal is located by the reference signals. In the power-saving method, the sink device obtains the HDCP information in the power-on region after the VSYNC signal is located.

In the embodiments of the invention, in the power-saving method, the HDCP information comprises AVMUTE control information and HDCP control information.

In the power-saving method for immediately switching HDMI ports of the invention, only the power being provided to the region that corresponds to the VSYNC active edge needs to be turned on at first. Therefore, the power consumption will be reduced. Furthermore, when the user switches one HDMI port to another port, the user can immediately see the video data without waiting a period of time for the HDCP re-authentication between the sink device and the source device.

Use of ordinal terms such as "first", "second", etc., in the disclosure and claims is for description. It does not by itself connote any order or relationship.

The steps of the method described in connection with the aspects disclosed herein may be embodied directly in hardware, in a software module executed by a processor, or in a combination of the two. A software module (e.g., including executable instructions and related data) and other data may reside in a data memory such as RAM memory, flash memory, ROM memory, EPROM memory, EEPROM memory, registers, a hard disk, a removable disk, a CD-ROM, or any other form of computer-readable storage medium known in the art. A sample storage medium may be coupled to a machine such as, for example, a computer/processor (which may be referred to herein, for convenience, as a "processor") such that the processor can read information (e.g., code) from and write information to the storage medium. A sample storage medium may be integral to the processor. The processor and the storage medium may reside in an ASIC. The ASIC may reside in user equipment. In the alternative, the processor and the storage medium may reside as discrete components in user equipment. Moreover, in some aspects, any suitable computer-program product may comprise a computer-readable medium comprising codes relating to one or more of the aspects of the disclosure. In some aspects, a computer software product may comprise packaging materials.

It should be noted that although not explicitly specified, one or more steps of the methods described herein can include a step for storing, displaying and/or outputting as required for a particular application. In other words, any data, records, fields, and/or intermediate results discussed in the methods can be stored, displayed, and/or output to another device as required for a particular application. While the foregoing is directed to embodiments of the present invention, other and further embodiments of the invention can be devised without departing from the basic scope thereof. Various embodiments presented herein, or portions thereof, can be combined to create further embodiments. The above description is of the best-contemplated mode of carrying out the invention. This description is made for the purpose of illustrating the general principles of the invention and should not be taken in a limiting sense. The scope of the invention is best determined by reference to the appended claims.

The above paragraphs describe many aspects. Obviously, the teaching of the invention can be accomplished by many methods, and any specific configurations or functions in the disclosed embodiments only present a representative condition. Those who are skilled in this technology will understand that all of the disclosed aspects in the invention can be applied independently or be incorporated.

While the invention has been described by way of example and in terms of preferred embodiment, it should be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A power-saving method for switching High Definition Multimedia Interface (HDMI) ports on a sink device, the sink device having a first HDMI port initially being enabled for displaying and a second HDMI port being disabled for displaying, the method comprising:

using, by a sink device, reference signals to locate a VSYNC active edge in each frame generated by a source device connected to the second HDMI port of the sink device;

turning on, by the sink device, power to the second HDMI port during a power-on region corresponding to the VSYNC active edge in each frame and turning off the power otherwise;

obtaining, by the sink device, information related to a high bandwidth digital content protection (HDCP) in the power-on region;

displaying, by the sink device, a video data from the source device based on the HDCP information when enabling the second HDMI port connected to the source device.

2. The power-saving method of claim 1, wherein the reference signals comprise at least two of a horizontal data enable signal, a vertical data enable signal, and a timing of pixel location.

3. The power-saving method of claim 2, wherein the VSYNC active edge is located by detecting edges of the reference signals.

4. The power-saving method of claim 3, wherein the detecting values of the reference signals comprises:

detecting whether the edges of the reference signals changing from a first value to a second value.

5. The power-saving method of claim 4, further comprising:

synchronizing a first clock of the source device with a second clock of the sink device before the VSYNC signal is located by the reference signals.

6. The power-saving method of claim 4, further comprising:

obtaining the HDCP information in the power-on region after the VSYNC signal is located.

7. The power-saving method of claim 1, wherein the HDCP information comprises AVMUTE control information and HDCP control information.

8. A High Definition Multimedia Interface (HDMI) device, comprising:

an HDMI interface, comprising a plurality of HDMI ports, wherein the plurality of HDMI ports comprise at least a first HDMI port initially being enabled for displaying and a second HDMI port being disabled for displaying;

a controller, coupled to the HDMI interface, wherein the controller uses references signals to locate a VSYNC active edge in each frame generated by a source device connected to the second HDMI port, turns on power to the second HDMI port during a power-on region corresponding to the VSYNC active edge in each frame and turns off power of the other regions in each frame, and obtains information related to a high bandwidth digital content protection (HDCP) from the power-on region; and a display device, coupled to the controller, wherein the display device displays video data from the source device based on the HDCP information when enabling the second HDMI port connected to the source device.

9. The HDMI device of claim 8, wherein the reference signals comprise at least two of a horizontal data enable signal, a vertical data enable signal, and a timing of pixel location.

10. The HDMI device of claim 9, wherein the controller locates the VSYNC active edge by detecting edges of the reference signals.

11. The HDMI device of claim 10, wherein the controller detects whether the edges of the reference signals changing from a first value to a second value.

12. The HDMI device of claim 11, wherein the controller synchronizes a first clock of the source device with a second clock of the sink device before the VSYNC signal is located by the reference signals.

13. The HDMI device of claim 11, wherein the controller obtains the HDCP information in the power-on region after the VSYNC signal is located.

14. The HDMI device of claim 8, wherein the HDCP information comprises AVMUTE control information and HDCP control information.

* * * * *